US005642330A

United States Patent [19]

Santopietro

[11] Patent Number: 5,642,330

[45] Date of Patent: Jun. 24, 1997

[54] SEA STATE MEASURING SYSTEM

[75] Inventor: Richard F. Santopietro, Waterford, Conn.

[73] Assignee: The United States of America as represented by the Secretary of the Navy, Washington, D.C.

[21] Appl. No.: 236,857

[22] Filed: May 2, 1994

[51] Int. Cl.[6] ..... B63G 8/14

[52] U.S. Cl. ..... 367/131; 114/244; 114/245; 73/170.33

[58] Field of Search ..... 367/130, 131; 114/244, 245, 253; 73/170.33

[56] References Cited

U.S. PATENT DOCUMENTS

| | | | |
|---|---|---|---|
| 2,750,794 | 6/1956 | Downs | 367/131 |
| 3,024,757 | 3/1962 | Aschinger | 114/244 |
| 3,034,471 | 5/1962 | Aschinger | 114/244 |
| 3,560,912 | 2/1971 | Spink et al. | 114/245 |
| 4,227,479 | 10/1980 | Gertler et al. | 114/253 |

*Primary Examiner*—Ian J. Lobo

*Attorney, Agent, or Firm*—Michael J. McGowan; Prithvi C. Lall; Michael F. Oglo

[57] ABSTRACT

A towed buoy is deployed to a known depth below the surface from a submarine and this depth is maintained by a control system that includes movable fins on the buoy. The movement of the buoy body and the buoy fins are monitored and used to evaluate sea state parameters, such as wave height for example. The tow cable is coupled to the buoy by means that permits measurement of the angle between the cable and the longitudinal axis of the buoy. Cable tension is also monitored to evaluate other surface parameters such as ocean current.

10 Claims, 1 Drawing Sheet

SEA STATE MEASURING SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to sea state measuring systems or devices, and relates more specifically to the deployment of a subsurface buoy, the position of the buoy is carefully controlled relative to the sea surface in order to provide information with respect to the surface sea state from locations below the sea surface, such as a submerged platform or submarine.

(2) Description of the Prior Art

A submerged vessel will have little knowledge of sea state, and historically must surface in order to provide the crew with a subjective qualitative picture of sea state. The more sophisticated methods currently in use rely on measurements of acoustic noise generated by sea surface waves and received by passive transducers contained on or near the submarine. Both these prior art approaches to the analysis of sea state lack the quantitative approach needed and achieved by subject invention.

The need for measuring surface conditions, particularly wave conditions, from a submerged submarine can be traced to the profound effect that the surface condition will have not only on a decision to launch submarine missiles, but also upon the potentially destabilizing effect of higher order sea states on the launching submarine itself.

Various methods for measuring ocean surface conditions such as wave heights and the like are currently available. However, such sensing methods include the need for tethered instrumented buoys such as accelerometer equipped buoys. The latter approach is demonstrated in Miller U.S. Pat. No. 4,794,575 wherein a submarine launched self-contained sea state buoy is disclosed. The buoy is adapted to float at the sea surface and transmits sea state data over a data link carried by the buoy tethering cable. Tethered buoys such as shown in the Miller patent limit submarine operating capabilities by placing restrictions on permissible submarine speed and depth for the period during which the buoy is deployed. In addition, the buoy can be detected by hostile forces more easily than with the system of the present invention.

Another prior art reference; U.S. Pat. No. 3,534,599 issued to Hoehne discloses an expendable ocean wave meter provided on a tethered floating buoy. Although a pressure sensing device is provided below the surface of the water the buoy is exposed at the surface and therefore this device suffers from the same disadvantages as referred to previously with reference to the Miller patent.

Middleton et al; U.S. Pat. No. 4,135,394 discloses, a wave amplitude measuring buoy. Here again the buoy must be provided at the surface of the water, and a single axis accelerometer provided a fixed distance below the water surface to monitor wave action. Furthermore, the output of the accelerometer must be stabilized to provide an output proportional only to the vertical acceleration of the buoy. The device and system of the present invention not only avoids the need for floating buoys at the sea surface, but also avoids many of the needs for accepting the inherent inaccuracies of these prior art systems and devices.

SUMMARY OF THE INVENTION

It is a general purpose and object of the present invention to provide a system for monitoring sea state at the surface from a submerged vessel such as a submarine without requiring use of a floating buoy or the like at the surface itself.

It is a further object to provide a tethered buoy that is provided below the surface of the ocean, but which is tethered to the underwater vessel or submarine by means of a cable, the cable including both command and data transmission channels for monitoring and controlling the attitude and/or location of the tethered buoy below the ocean surface.

These objects are accomplished with the system of the present invention by providing a cable tethered underwater buoy at some distance below the surface of the sea. The buoy is either operated at a constant attitude relative to the horizontal while it is towed behind the submarine or maintains a constant depth below the water surface. Fins on the buoy are operated by a suitable control system which compares the variations in fin position and the related buoy motion response to a suitable reference to provide a quantitative picture of surface sea state.

In a first embodiment, that is where the buoy is provided at a predetermined distance below the surface of the ocean the movable fins are provided on the buoy for actuation by conventional means in response to a control system that dictates motion for these fins in order to provide feedback to the buoy so as to maintain the constant depth desired for the buoy below the sea surface. The positions of these fins as they are so actuated are monitored by transducers so as to provide continuous information, along with the information from the buoy motion sensor, that can be translated into the requisite information for determining the sea state at the surface.

In a second, or an alternative embodiment, that is where the buoy is towed below the surface at a predetermined depth and attitude of the longitudinal axis of the buoy relative to the horizontal, the same measurements can be taken, that is the necessary movement of control fins aboard the buoy can be monitored, along with the measurements of buoy motion to provide a quantitative indication of the sea state at the surface.

Both systems described above also include means for monitoring variations in both cable tension and the angle of the cable relative to the longitudinal axis of the buoy for purposes of providing an indication of surface currents and eddies or the like. That is, tow cable tension will be a function of the encounter angle between the instantaneous orientation of the longitudinal axis of the buoy relative to the direction of the current. So too, the average value of the angle between the tow cable and the buoy in a horizontal plane, as well as any roll angle of the buoy, will provide information such that the angle of the current relative to the direction taken by the buoy at any instant of time can be monitored. Where the buoy is towed, for example, in a following sea (that is in the same direction as wave velocity) the information from cable tension and yaw and pitch angles will provide data from which this parameter relative to sea state can be monitored.

In operation a winch aboard the submarine deploys the buoy to a known depth below the surface. The length or scope of cable is recorded and the fins operated to maintain the target depth, or to maintain the predetermined buoy attitude. As wave action disturbs the buoy the fin movement necessary to maintain the depth and/or the attitude is monitored, along with measurements of buoy motion, to provide a quantitative indication of sea state parameters.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein a single FIGURE shows the essential components of the present invention in a schematic fashion.

DESCRIPTION OF THE PREFERRED EMBODIMENT

Figure 1:
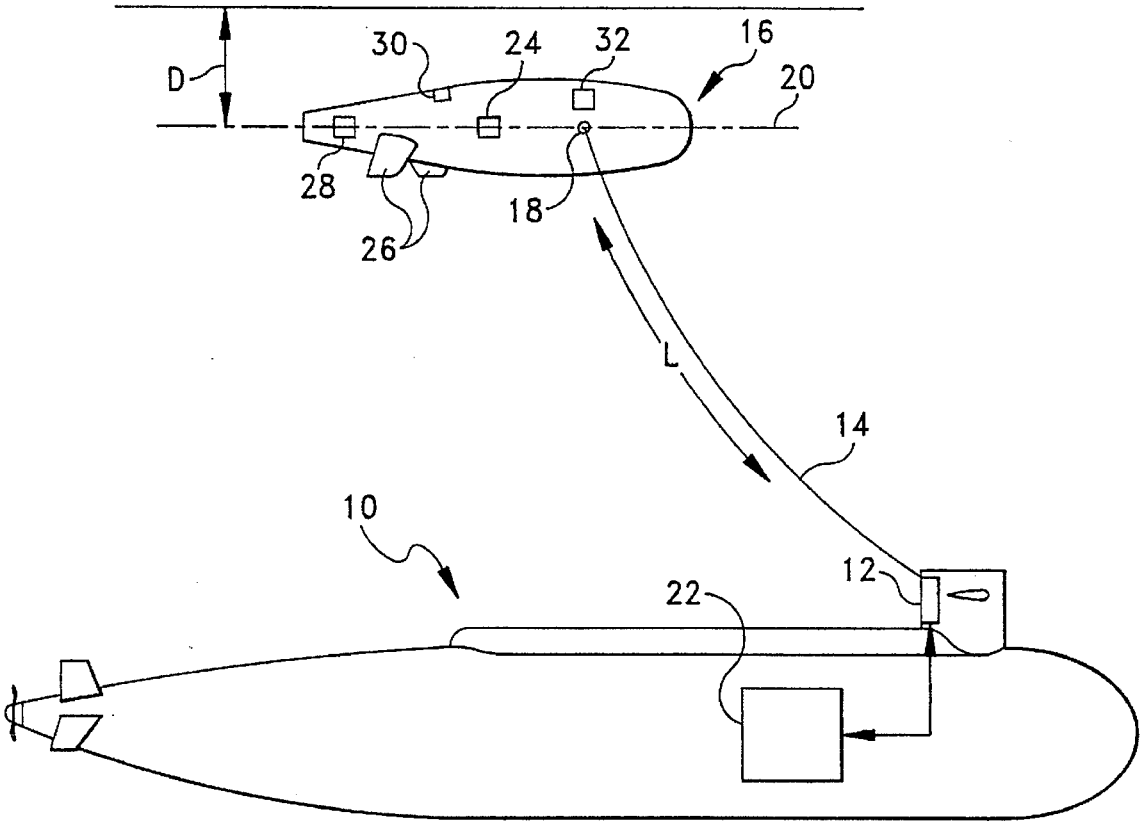

Referring now to the single accompanying FIGURE there is shown a submarine 10 of conventional construction, and fitted with a cable winching device 12 capable of deploying a cable 14 from the submarine, the cable 14 has an end portion, indicated generally at 18, secured to a buoy 16 to be described. The buoy 16 is secured to the cable 14 by coupling means located generally at 18 that includes means for monitoring the tension in the cable 14, as well as means for monitoring the angular relationship between the end of the cable at the coupling 18 relative to the longitudinal axis 20 of the towed buoy 16. This capability is provided for not only in the vertical plane, but also in the horizontal plane. Thus, the angle of yaw if any between the longitudinal axis of the towed buoy 16 and the upper end of the cable at the coupling 18 is continuously monitored as is the relative angular relationship between the longitudinal axis 20 and the upper end of the cable in a vertical plane.

The cable 14 includes command and data communication channels between the submarine and more particularly between means 22 aboard the submarine and means 24 aboard the towed buoy 16. Still with reference to the towed buoy 16 fins 26 are provided for movement on axes defined by the buoy 16 for purposes of controlling the attitude of the towed buoy both in pitch, roll, and yaw. These fins not only include actuator means for such movement, but also means is provided for monitoring variations in the positions of these fins as suggested generally at 28 in the FIGURE.

A further feature of the present invention is to provide motion sensor means aboard the towed buoy to sense buoy motion including position, velocity, and acceleration in three dimensions. Such transducer means is indicated generally at 32 and will be referred to herein as first, or as static pressure, transducer means.

The control means of the present invention may be provided at least in part aboard the submarine as suggested generally at 22. Alternatively, the control means may be provided in part aboard the submarine and in part aboard the towed buoy 16. For example, the first transducer means 30 and/or motion sensor means 32 comprises a portion of the control means, which control means also includes the generation of command signals for the fin actuating means to cause said buoy to continuously seek a predetermined depth D below the surface of the sea as suggested in the FIGURE. The control system provided in part on the towed buoy 16 includes the above mentioned fin motion sensor means 28 for monitoring changes in fin position for each of the control fins on that towed buoy 16.

Still with reference to said control means, the portion aboard the submarine preferably includes means for comparing the variations in fin positions to reference positions at known conditions of speed and depth for both the submarine 10 and buoy 16 said fins associated with known orientations of said towed buoy device 16 relative to the horizontal and vertical.

The system of the present invention includes the aforementioned means 12 for deploying said buoy cable 14, and said means is preferably in the form of a winch capable of providing continuous readout of the length L of said deployed cable so that the length of the deployed cable required to achieve the known distance D of the towed buoy 16 below the water surface can be known for a given submarine depth and/or speed. The coupling means 18 provided for connecting the buoy 16 to the cable 14 includes means for measuring the angle defined by the cable at the coupling means and the longitudinal axis of the buoy 20. The cable 14 also includes means preferably at the coupling 18 between the cable and the buoy and between the cable and the winch 12 for measuring tension at both ends of the cable.

DETAILED DESCRIPTION OF ALTERNATIVE EMBODIMENT

In accordance with a second or alternative version of the present invention, and as an alternative or supplement to maintaining the depth D of the towed buoy 16 below the water surface, the towed buoy 16 may instead be controlled to maintain a particular attitude of the buoy 16 below the water surface. Thus, when the surface effects of a sea state exert forces on the towed buoy the action of the fins 26 will be such as to maintain the present buoy attitude regardless of these forces. The resulting movement of the fins 26 can be used in much the same manner as described above with reference to fin movement for achieving a static buoy position below the surface of the sea itself.

Obviously, the parameters stored in the control system for comparing these fin positions and/or motion sensor responses will differ from the stored information provided in the above mentioned first embodiment of the invention. As an example, the buoy can be operated without any fin motion, but the buoy must be located at such a depth below the sea surface to avoid broaching. At present I prefer the first above mentioned version of my invention as the best mode for carrying out said invention. Further, I prefer that the invention described would be of very small size, have no mass and be made of rigid, strong material, so that the buoy motions would correspond very accurately to the encountered fluid particle velocities that are a part of sea surface motion and bulk flow. In practice, finite volume is required to house the required buoy motion sensors and control actuators. The present embodiment uses a buoy constructed of fiberglass and metal components, is 300 cm long, 90 cm wide, 50 cm high, weighs 1000 pounds, and is towed by a steel reinforced cable that has a diameter of 0.89 cm. Obviously many modifications and variations of the present invention may become apparent in light of the above teachings.

In light of the above, it is therefore understood that within the scope of the appended claims, the invention may be practiced otherwise than as specifically described.

What is claimed is:

1. A system for measuring sea state from a submarine comprising:

an underwater or subsurface buoy;

cable means for towing said buoy from the submarine and including command and data communication channels between the submarine and said buoy;

buoy motion sensor means including first transducer means aboard said buoy for sensing buoy motion including position, velocity and acceleration in three dimensions;

said buoy having movable fins to provide the towed buoy with at least pitch change capability;

fin actuating means for moving said fins to change the pitch of said buoy relative at least to its longitudinal axis;

control means including second transducer means aboard said buoy to sense the depth of said buoy below the surface of the water, said control means generating command signals for said fin actuator means to cause said buoy to continuously seek a predetermined depth D below the surface of the sea;

fin motion sensor means for monitoring changes in fin position to provide a quantitative measure of wave action at the surface; and means for evaluating variations in fin position to provide indication of sea state parameters.

2. The system of claim 1 which further includes means for comparing any variations in buoy motion to reference motions for known sea conditions.

3. The system of claim 2 which further provides means for evaluating variations in buoy motion to provide indication of sea state parameters.

4. The system according to claim 3 further characterized by third transducer means for sensing the tension in said cable means.

5. The system according to claim 4 further characterized by fourth transducer means for sensing the yaw angle defined between the cable at a coupling means in said buoy and the longitudinal axis of said buoy.

6. A system for measuring sea state from a submarine comprising:

an underwater or subsurface buoy;

cable means for towing said buoy from the submarine and including command and data communication channels between the submarine and said buoy;

buoy motion sensor means including first transducer means aboard said buoy for sensing buoy motion including position, velocity and acceleration in three dimensions;

said buoy having movable fins to provide the towed buoy with at least pitch change capability;

fin actuating means for moving said fins to change the pitch of said buoy relative at least to its longitudinal axis;

control means including second transducer means aboard said buoy to sense the depth of said buoy below the surface of the water, said control means generating command signals for said fin actuator means to cause said buoy to continuously seek a predetermined depth D below the surface of the sea;

fin motion sensor means for monitoring changes in fin position to provide a quantitative measure of wave action at the surface;

cable tension measuring means; and means for comparing variations in cable tension to a reference tension value selected from a table of various tension values that vary according to sea state parameters.

7. A system for measuring sea state from a submarine comprising:

an underwater subsurface buoy of elongated configuration;

cable means for towing said buoy from the submarine including command and data communication channels between the submarine and said buoy;

said buoy having movable fins to provide the towed buoy with pitch change capability;

motion sensor means including a transducer means aboard said buoy to sense the buoy motion including position, velocity and acceleration in three dimensions;

fin actuator means for moving said fins to change the pitch of said buoy;

control means including attitude sensing means to sense the attitude of said buoy at least relative to the horizontal and to the vertical, said control means generating command signals for said fin actuator means to cause said buoy to continuously seek a predetermined attitude as it is towed by the cable from the submarine; and fin motion sensor means for monitoring changes in fin position.

8. The system according to claim 7 further characterized by means for comparing any variations in fin position to reference fin positions for various submarine and buoy speeds and depths, said reference positions bear known relationships to parameters of said sea state.

9. A system for measuring sea state from a submarine comprising:

an underwater subsurface buoy of elongated configuration;

cable means for towing said buoy from the submarine including command and data communication channels between the submarine and said buoy;

said buoy having movable fins to provide the towed buoy with pitch chance capability;

motion sensor means including a transducer means aboard said buoy to sense the buoy motion including position, velocity and acceleration in three dimensions;

fin actuator means for moving said fins to change the pitch of said buoy;

control means including attitude sensing means to sense the attitude of said buoy at least relative to the horizontal and to the vertical, said control means generating command signals for said fin actuator means to cause said buoy to continuously seek a predetermined attitude as it is towed by the cable from the submarine;

fin motion sensor means for monitoring changes in fin position to provide a quantitative measure of wave action at the surface; and means for evaluating variations in fin position to provide indication of sea state parameters.

10. A system for measuring sea state from a submarine comprising:

an underwater subsurface buoy of elongated configuration;

cable means for towing said buoy from the submarine including command and data communication channels between the submarine and said buoy;

said buoy having movable fins to provide the towed buoy with pitch change capability;

motion sensor means including a transducer means aboard said buoy to sense the buoy motion including position, velocity and acceleration in three dimensions;

fin actuator means for moving said fins to change the pitch of said buoy;

control means including attitude sensing means to sense the attitude of said buoy at least relative to the horizontal and to the vertical, said control means generating command signals for said fin actuator means to cause said buoy to continuously seek a predetermined attitude as it is towed by the cable from the submarine;

fin motion sensor means for monitoring changes in fin position to provide a quantitative measure of wave action at the surface; and means for comparing any variation in buoy motion to reference motions for known sea state conditions.

* * * * *